US006093489A

United States Patent [19]

Watanabe

[11] Patent Number: 6,093,489

[45] Date of Patent: Jul. 25, 2000

[54] REINFORCING TAPE FOR SLIDE FASTENER

[75] Inventor: Kozo Watanabe, Kurobe, Japan

[73] Assignee: YKK Corporation, Tokyo, Japan

[21] Appl. No.: 09/071,733

[22] Filed: May 1, 1998

[30] Foreign Application Priority Data

May 2, 1997 [JP] Japan ..... 9-127819

[51] Int. Cl.[7] ..... C09J 7/02

[52] U.S. Cl. ..... 428/349; 428/216; 428/355 R

[58] Field of Search ..... 428/349, 355 R, 428/216

[56] References Cited

U.S. PATENT DOCUMENTS

| | | |
|---|---|---|
| 3,490,970 | 1/1970 | Heimberger et al. . |
| 3,663,996 | 5/1972 | Heimberger et al. . |
| 4,651,389 | 3/1987 | Yoshida et al. . |
| 4,922,584 | 5/1990 | Funakawa et al. . |
| 5,231,737 | 8/1993 | Fröhlich et al. . |
| 5,728,460 | 3/1998 | Hirasawa et al. . |

FOREIGN PATENT DOCUMENTS

| | | |
|---|---|---|
| 44-25843 | 8/1965 | Japan . |
| 62-149780 | 12/1985 | Japan . |
| 8-299033 | 11/1996 | Japan . |

OTHER PUBLICATIONS

Patent Abstracts of Japan Application No. 60291673 dated Dec. 24, 1985.

*Primary Examiner*—Christopher Raimund
*Attorney, Agent, or Firm*—Hill & Simpson

[57] ABSTRACT

A reinforcing tape for a slide fastener is disclosed. The reinforcing tape to be bonded to the end portion of a fastener tape comprises a reinforcing layer formed of a polyester elastomer film manifesting a modulus of elasticity in bending in the range of 3,000 to 5,000 kg/cm$^2$ and an adhesive layer. Preferably a polyester-based hot-melt adhesive is used for the adhesive layer.

8 Claims, 5 Drawing Sheets

REINFORCING TAPE FOR SLIDE FASTENER

BACKGROUND OF THE INVENTION

1. Field of the Invention

This invention relates to a reinforcing tape or reinforcing sheet material to be attached to the end portion of a fastener tape which is intended for allowing attachment of a pin-and-socket separator.

2. Description of the Prior Art

The reinforcing tapes to be attached to the end portions of fastener tapes have been heretofore known in various types. The conventional reinforcing tapes include those which, for the sake of obviating the necessity of preparing reinforcing tapes dyed specially in various colors matched to the colors of dyed fastener tapes and consequently saving such time and labor as would otherwise be incurred in the inventory control, use transparent synthetic resin films in a superposed manner so as to show the colors of the dyed fastener tapes therethrough. For example, the reinforcing piece which is formed of two superposed transparent synthetic resin films having different melting points and is adapted to be applied fast to a fastener tape by melting that of the two films having a lower melting point as disclosed in Japanese Utility Model Publication No. (hereinafter referred to briefly as "JUM-B-") 44-25,843 and the lateral application tape which is formed by superposing on one side of a transparent film of nylon 6 or nylon 66 a transparent polyester copolymer film having a melting point of not more than 200° C. so as to show the color of the base fabric of the fastener tape therethrough as disclosed in published Japanese Patent Application, KOKAI (Early Publication) No. (hereinafter referred to briefly as "JP-A-") 62-149,780 have been known to the art.

Since the reinforcing tapes formed of two layers of synthetic resin film as are disclosed in JUM-B-44-25,843 and JP-A-62-149,780 mentioned above are hard from the material point of view, they cannot be easily shaped by bending in conformity with the shape of the core portion of the fastener tape intended for permitting attachment of a pin-and-socket separator and, for this reason, the core portion of the fastener tape is not easily formed accurately in contour thereof. Further, these reinforcing tapes have the problem that when they are repeatedly bent, the bent lines thereof ultimately cause whitening possibly to the extent of jeopardizing the appearance of the reinforcing tapes.

To solve such problems, JP-A-8-299,033 filed by the assignee of this application proposes a reinforcing tape using a transparent polyester elastomer film as a surface layer and having an adhesive layer superposed on the reverse side thereof.

SUMMARY OF THE INVENTION

The reinforcing tape disclosed in JP-A-8-299,033 mentioned above has the surface layer (reinforcing layer) thereof formed of a polyester elastomer film and, therefore, enjoys the advantage of possessing flexibility enough to be folded in conformity with the contour of the core portion of the fastener tape as compared with a reinforcing tape formed of synthetic resin film.

When the polyester elastomer film is used for the reinforcing layer and this film happens to be supple and excellent in transparency, however, since the film is deficient in resistance to dry cleaning, the reinforcing tape is at a disadvantage in readily swelling after dry cleaning, suffering a decline in peel strength, rendering the work of adhesion of the film difficult, and manifesting insufficient strength. When a polyester elastomer film of high rigidity is used instead for the purpose of improving the resistance to dry cleaning, workability, and strength, however, since the rigidity is unduly high, the produced reinforcing tape is at a disadvantage in encountering difficulty in shaping the tape as folded in conformity with the contour of the core portion of the fastener tape and suffering degradation of transparency.

It is, therefore, an object of the present invention to provide a reinforcing tape for a slide fastener, which finely reconciles such contradicting merits and demerits of the polyester elastomer film as the reinforcing layer, excels in suppleness and transparency, and possesses high resistance to dry cleaning and high strength.

A further object of the present invention is to provide a reinforcing tape for a slide fastener, which can be easily shaped in conformity with the contour of the core portion of a fastener tape intended for the attachment of a fitting metal piece such as a pin-and-socket separator, allows the color of a dyed fastener tape to be faithfully seen therethrough, and excels in durability and strength.

To accomplish the objects mentioned above, the present invention provides a reinforcing tape for a slide fastener, characterized by comprising a polyester elastomer film manifesting a modulus of elasticity in bending in the range of 3,000 to 5,000 kg/cm$^2$ and an adhesive layer.

In a preferred embodiment of the present invention, a polyester-based hot-melt adhesive is used for the adhesive layer mentioned above.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
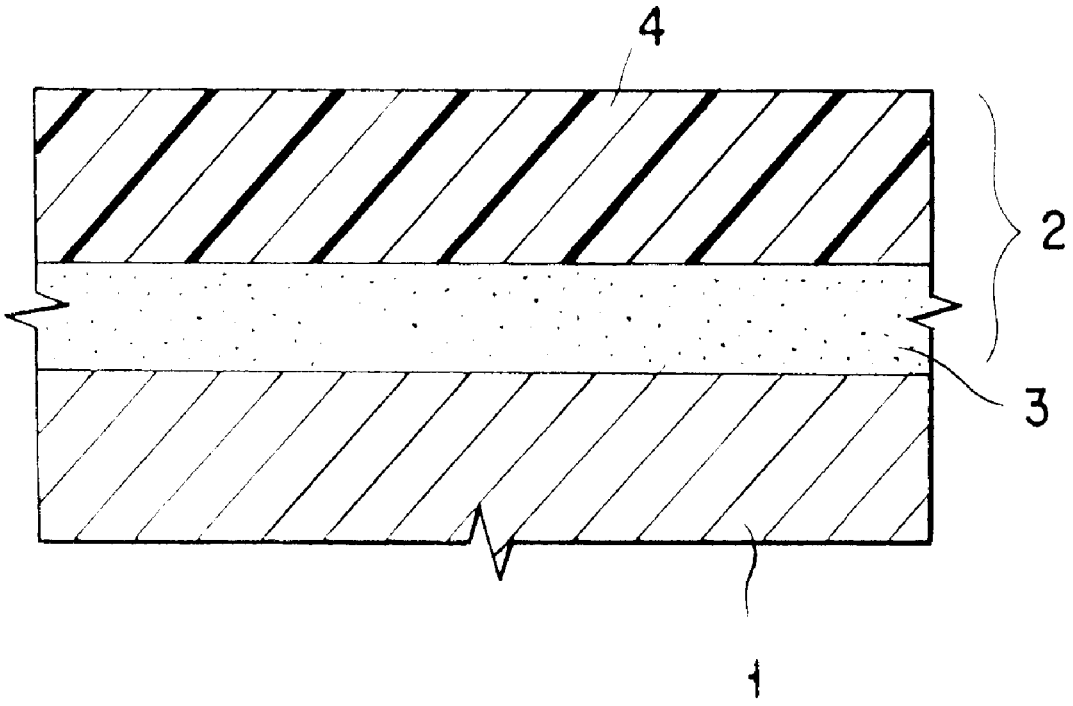
FIG. 1 is a fragmentary cross-sectional view of the end portion of a fastener tape fitted with a reinforcing tape of the present invention.

The use of the polyester elastomer film for the reinforcing layer of a reinforcing tape has been already known as described above. When the polyester elastomer film is used for the reinforcing layer and this film happens to be supple and excellent in transparency, however, since the film is deficient in resistance to dry cleaning, the reinforcing tape is at a disadvantage in readily swelling after dry cleaning, suffering a decline in peel strength, rendering the work of adhesion of the film difficult, and manifesting insufficient strength. When a polyester elastomer film of high rigidity is used instead for the purpose of improving the resistance to dry cleaning, workability, and strength, however, since the rigidity is unduly high, the produced reinforcing tape has the disadvantage of encountering difficulty in shaping the tape as folded in conformity with the contour of the core portion of the fastener tape and suffering degradation of transparency. In the actual product, therefore, nylon film or plain weave fibers are used for the reinforcing layer. The reinforcing tape using a polyester elastomer film has not yet been reduced to practice.

The present inventor has found that such contradicting merits and demerits of the polyester elastomer film as mentioned above can be finely reconciled by controlling the modulus of elasticity in bending of this film within a specific range, i.e. in the range of 3,000 to 5,000 kg/cm$^2$.

As a result of a diligent study concerning the quality of the polyester elastomer film which brings about such merits and demerits as mentioned above, it has been ascertained that a film having a modulus of elasticity in bending of less than 3,000 kg/cm$^2$ is deficient in resistance to dry cleaning and in strength to resist a lateral pull exerted on a pin-and-socket separator because of a small crystal content and a film having a modulus of elasticity in bending exceeding 5,000 kg/cm$^2$ is deficient in transparency and flexibility because of an unduly high crystal content. When a polyester elastomer film having a modulus of elasticity in bending in the range of 3,000 to 5,000 kg/cm$^2$ is used for the reinforcing layer, it allows manufacture of a reinforcing tape for a slide fastener which excels in suppleness and transparency and possesses highly satisfactory resistance to dry cleaning in combination with high strength. Incidentally, though the modulus of elasticity in bending of the reinforcing tape in its entirety hinges heavily on the modulus of elasticity in bending of the polyester elastomer itself because the adhesive layer of the reinforcing tape has a small thickness and low rigidity as compared with the reinforcing layer, it is affected by the kind, thickness, etc. of the adhesive layer. It is, therefore, preferable for the kind, thickness, etc. of the adhesive layer to be selected such that the modulus of elasticity in bending of the reinforcing tape in its entirety falls in the range of 3,000 to 5,000 kg/ cm$^2$.

Now, the present invention will be described more specifically below with reference to the preferred embodiments which are illustrated in the annexed drawings.

FIG. 1 illustrates one example of the construction of a reinforcing tape 2 attached to the end portion of a fastener tape 1 of a slide fastener according to the present invention. The reinforcing tape 2 is constructed by superposing a reinforcing layer 4 on the fastener tape 1 through the medium of an adhesive layer 3. For the reinforcing layer 4, a polyester elastomer film manifesting a modulus of elasticity in bending in the range of 3,000 to 5,000 kg/cm$^2$ as mentioned above is used.

The construction, as depicted in FIG. 1, has the reinforcing tape 2 superposed on only one side of the fastener tape 1. Of course, this superposition may be made on both sides of the fastener tape 1. Generally, it is made on both the obverse and the reverse side.

The thickness of the reinforcing layer 4 using the polyester elastomer film is proper generally in the range of 50 to 200 $\mu$m, preferably in the approximate range of 100 to 200 $\mu$m.

The thickness of the adhesive layer 3 is proper generally in the range of 30 to 120 $\mu$m, preferably in the range of 50 to 70 $\mu$m.

For the adhesive layer 3, various adhesive agents which have been heretofore known as suitable for the reinforcing tape can be used. The adhesive agent does not need to be limited to any specific kind. It is, however, preferred to be a hot-melt adhesive having affinity for the material of the fastener tape 1, particularly a hot-melt adhesive using resin of the same type as the raw material of the fastener tape. When the material of the fastener tape 1 is polyester fibers, for example, the polyester hot-melt adhesive having as the base polymer thereof a transparent polyester copolymer can be advantageously used. When the material of the fastener tape is nylon, the polyamide hot-melt adhesive having as the base polymer thereof a low melting transparent nylon copolymer of at least three components obtained by copolymerizing such monomers as nylon 6, nylon 66, nylon 610, and nylon 612 can be advantageously used.

Among other hot-melt adhesives, the hot-melt adhesives manifesting a melting point in the range of 110° to 120° C. and a melt viscosity at 200° C. in the range of 1,000 to 2,000 poises prove to be particularly desirable.

Heretofore, a high melting and high viscosity hot-melt adhesive manifesting a melting point in the range of 130° to 140° C. and a melt viscosity at 200° C. in the range of 4,000 to 6,000 poises is commonly used to form an adhesive layer. When the reinforcing tapes are attached to the fastener tapes by the use of an adhesive layer having such high melting point and high melt viscosity, however, a product which is fitted with the fastener tapes, on being laundered or dry cleaned, encounters the problem that the peel strength between the reinforcing tape and the fastener tape is degraded to the extent of rendering the reinforcing tape easy to peel. This is because the melt viscosity of the hot-melt adhesive is unduly high and, as a result, the hot-melt adhesive, while mediating adhesion between the reinforcing tape and the fastener tape, encounters difficulty in penetrating the interstices of the fibers of the fastener tape and fails to produce a fully satisfactory anchoring effect.

In contrast, when the hot-melt adhesive having a relatively low melting point in the range of 110° to 120° C. and a low melt viscosity at 200° C. in the range of 1,000 to 2,000 poises is used for the adhesive layer of the reinforcing tape, it easily melts during the attachment of the reinforcing tape to the fastener tape by simultaneous application of heat and pressure, the molten resin consequently produced easily penetrates the interstices of the fibers of the fastener tapes, and the resin, on being cooled and hardened, continues its existence between the fibers and manifests a high anchoring effect. A product which is furnished with the fastener tape having its end portion reinforced as described above, therefore, maintains high peel strength between the reinforcing tape and the fastener tape even after the product has been laundered or dry cleaned.

The reinforcement of the end portion of the fastener tape 1 may be carried out by applying the adhesive layer 3 to the surface of the end portion of the fastener tape 1, then superposing the reinforcing layer 4 on the adhesive layer 3, and joining the superposed layers by simultaneous application of heat and pressure. It is, however, effected preferably by a procedure which comprises preparing the reinforcing tape 2 having the reinforcing layer 4 coated on one side thereof with the adhesive layer 3 by the known technique of superposition such as, for example, the dry laminating technique or coextruding technique and bonding this reinforcing tape 2 to the surface of the end portion of the fastener tape 1 through the medium of the adhesive layer 3 by simultaneous application of heat and pressure. Though such heating means as a hot plate, ultrasonic wave, or high frequency are available for the use of heat in the simultaneous application of heat and pressure. Among other heating means, it is preferred to use ultrasonic wave.

When the reinforcing tape is bonded to the fastener tape by simultaneous application of heat and pressure, the problem arises that bubbles tend to enter between the adhesive layer of the reinforcing tape and the fastener tape where the reinforcing layer is formed of resin film (or further between the adhesive layer and a reinforcing layer where the adhesive layer is applied to the fastener tape and then the reinforcing layer is superposed thereon) and impair the appearance. This entry of bubbles may be logically explained by a supposition that the fastener tape of a fabric produced by weaving or knitting synthetic fibers or natural fibers has an undulating surface and, when the reinforcing tape of flat surface is applied to such undulating surface, the air entrapped between the depressions in the surface of the fastener tape and the reinforcing tape are liable to persist as bubbles. According to the inventor's study, it has been found that this problem can be eliminated by using ultrasonic wave as a heat source.

As respects the step for effecting the attachment by the use of the ultrasonic wave, first the adhesive layer is interposed between the fastener tape and the reinforcing tape and then these tapes are nipped and compressed between an anvil and a horn. Subsequently, the superposed layers are made to generate heat by exposure to ultrasonic vibration until the tapes are joined. Thereafter, the ultrasonic vibration is stopped and the anvil and the horn are cooled as held in a state compressing the fastener tape and the reinforcing tape.

According to such step of attachment, since the anvil and the horn jointly keep the fastener tape and the reinforcing tape nipped and compressed therebetween until the adhesive agent fixes the fastener tape and the reinforcing tape completely to each other by adhesion and further since the anvil and the horn keep the fastener tape and the reinforcing tape exposed to ultrasonic vibration and meanwhile nipped and compressed therebetween, the bubbles are gradually expelled from between the tapes by the vibration. As a result, the entry of bubbles between the fastener tape and the reinforcing tape (adhesive layer) occurs only with difficulty.

Further, this step of attachment allows manufacture of a fastener product excelling in appearance because the molten resin attains easy entry between the fibers of the fastener tape, enhances the adhesive strength of the reinforcing tape to the fastener tape, and enables itself to cool and solidify within a die as well. The ultrasonic wave used as a heat source brings about the advantage of enjoying an increase in the cooling rate and improvement in productivity as compared with the hot plate as a heat source.

For the purpose of precluding the entry of bubbles between the adhesive layer and the reinforcing layer during the step of attachment, the procedure which comprises preparing a one-piece reinforcing tape having an adhesive layer superposed in advance on a reinforcing layer and then attaching this reinforcing tape to the fastener tape proves to be a preferable practice.

Figure 2:
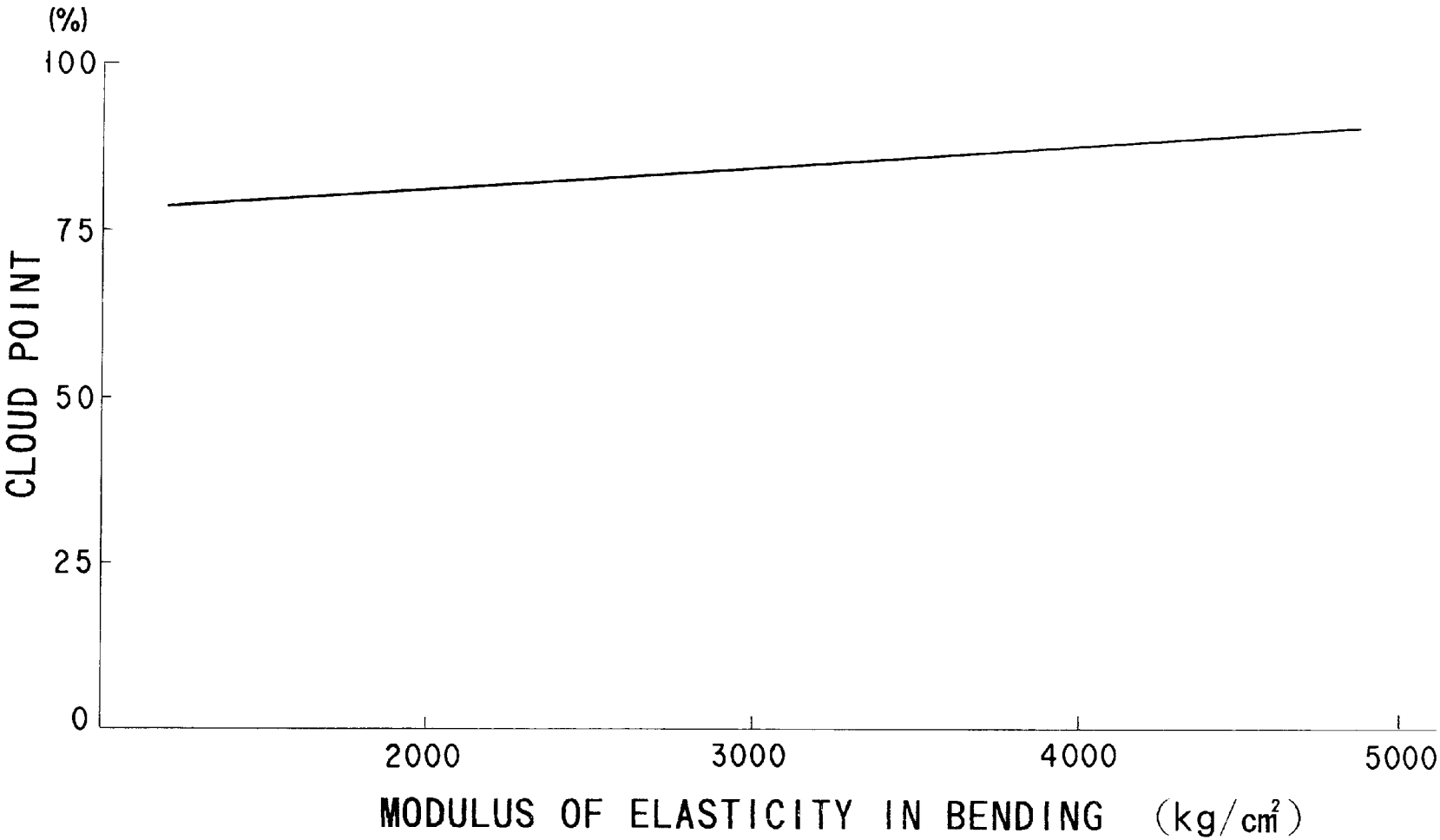
FIG. 2 is a graph showing the relation between the modulus of elasticity in bending and the cloud point of the reinforcing tape.
Figure 3:
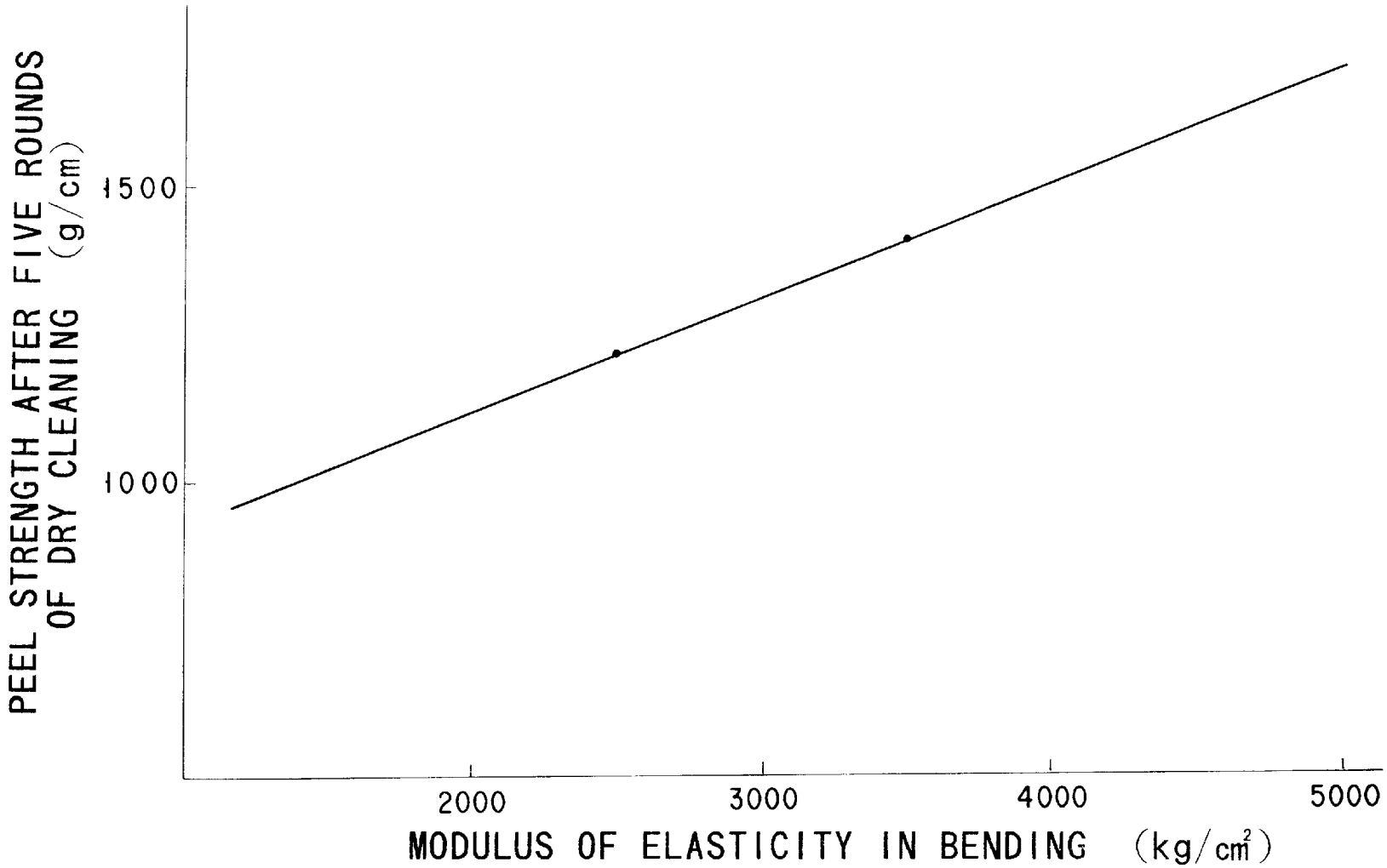
FIG. 3 is a graph showing the relation between the modulus of elasticity in bending of the reinforcing tape and the peel strength after five rounds of dry cleaning.
Figure 4:
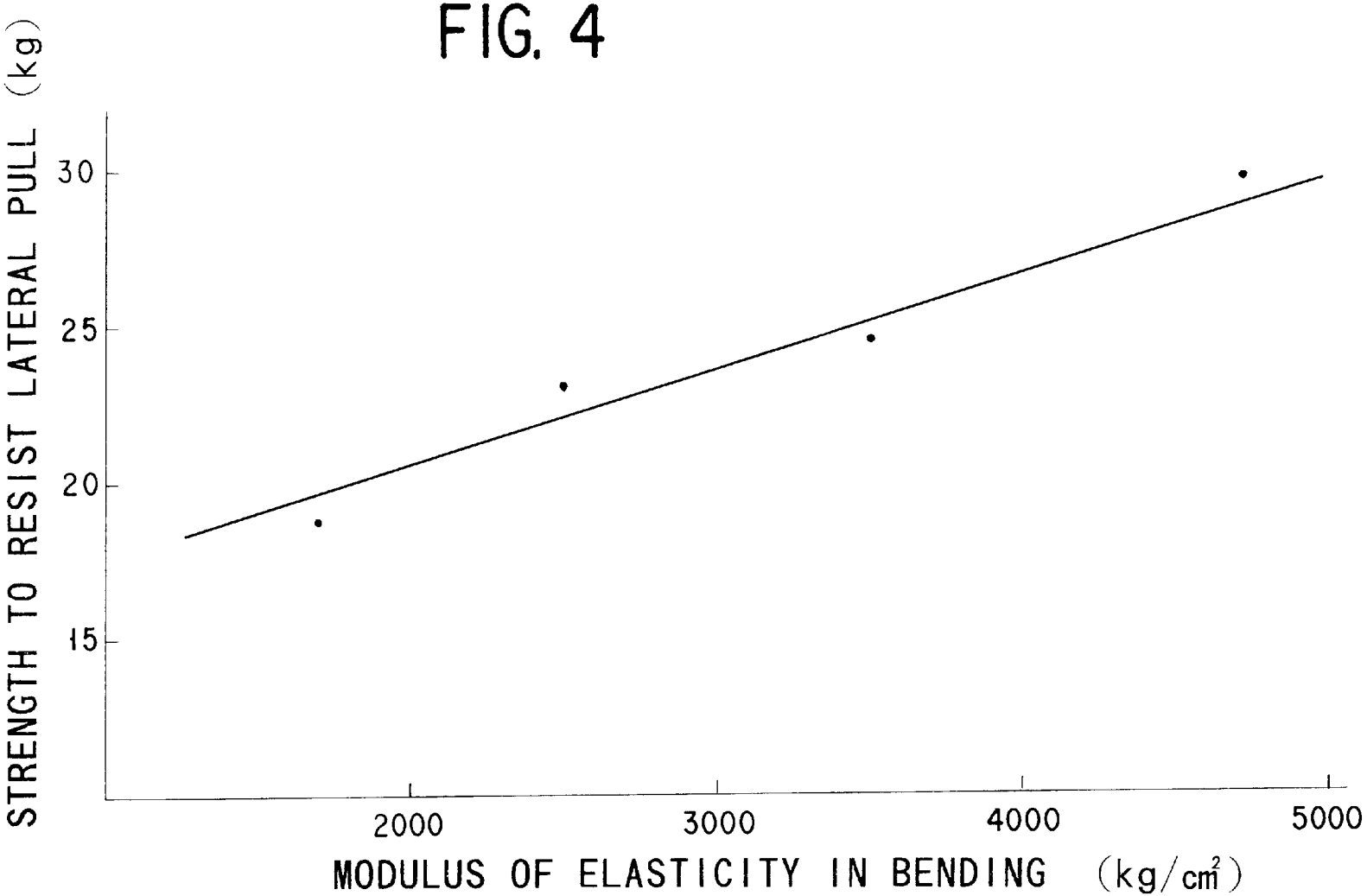
FIG. 4 is a graph showing the relation between the modulus of elasticity in bending of the reinforcing tape and the strength to resist a lateral pull exerted on a pin-and-socket separator.

The relations of the modulus of elasticity in bending of the reinforcing tape with the cloud point (transparency), with the resistance to dry cleaning (peel strength after five rounds of dry cleaning), and with the strength to resist the lateral pull exerted on a pin-and-socket separator are shown in FIGS. 2–4 respectively.

The cloud point shown in FIG. 2 was obtained by preparing a test piece of a reinforcing tape having a layer, 60 $\mu$m in thickness, of a polyester hot-melt adhesive laminated on a polyester elastomer film, 120 $\mu$m in thickness, measuring the test piece for transmittance by the same procedure as the test for light transmittance in accordance with the method for testing cloud point specified in JIS (Japanese Industrial Standard) K 6714, and computing the cloud point (%) based on the formula, (Td/Tt) X 100, wherein Td stands for the transmittance of scattered light and Tt for the transmittance of whole light.

The resistance to dry cleaning and the strength to resist the lateral pull exerted by a pin-and-socket separator shown in FIG. 3 were both results of relevant tests performed on slide fastener stringers having the aforementioned reinforcing tapes attached thereto.

The test for the resistance to dry cleaning was carried out as follows. A test piece which was obtained by attaching the reinforcing tape to a pair of slide fastener stringers having the coupling elements thereof kept in a meshed state such that the reinforcing tape intersected the row of coupling elements was subjected to dry cleaning performed by carrying out up to five repetitions the series of steps of rinsing the test piece with perchloroethylene twice each for three minutes, then draining the rinsed test piece by high-speed rotation for three minutes and meanwhile treating it by the use of an instrument sold under the trademark of "Spraymatic" (for the sake of preventing static electrification, conferring soft finish, and furnishing protection against microbe and odor), then drying the treated test piece at 70° C. for 15 minutes, and further gradually cooling and drying it for five minutes. Then, the peel strength of the test piece was determined by dividing the reinforcing tape in the test piece into two halves along a cut inserted in the center of the meshed coupling elements and peeling the right half of the reinforcing tape from the test piece by pulling the right cut edge up and meanwhile measuring the strength required for peeling.

Figure 5:
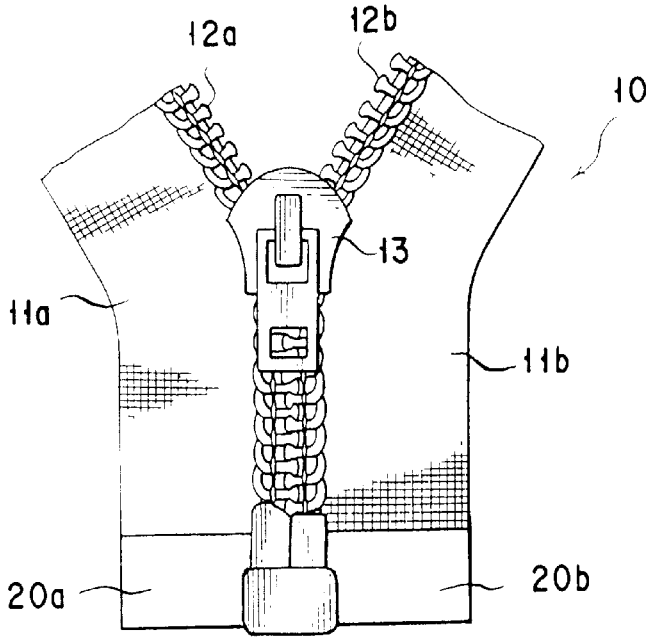
FIG. 5 is a fragmentary plan view showing the lower part of a slide fastener provided with reinforcing tapes of the present invention.

The test for the strength to resist lateral pull (transverse tensile strength) was carried out as follows. Reinforcing tapes 20*a* and 20*b* were attached to the end portions of fastener tapes 11*a* and 11*b* and a pin-and-socket separator composed of a butterfly bar 14, box bar 15, and box member 16 and disposed in the ends of the rows of coupling elements 12*a* and 12*b* of the fastener tapes was put into a closed state as illustrated in FIG. 5. A pair of laterally opposed grippers were caused to nip the laterally opposed fastener tapes in the attached part of the reinforcing tape and the grippers were moved laterally relative to the fastener tapes (in the direction of forcing the grippers away from each other) to give a lateral pull to the laterally opposed fastener tapes and the load produced separation of the pin-and-socket separator was recorded. This procedure was performed up to five repetitions and the average of the five measurements was reported as the strength to resist the lateral pull.

The cloud point described a linear relation with the modulus of elasticity in bending of the reinforcing tape as shown in FIG. 2. The graph indicates that the cloud point declines, namely the transparency improves, in accordance as the modulus of elasticity in bending decreases. For the color of the fastener tape to be seen through the reinforcing tape, the cloud point of the reinforcing tape must be not more than about 90%. As a consequence, the modulus of elasticity in bending of the reinforcing tape must be not more than about 5,000 kg/cm$^2$.

Then, the resistance to dry cleaning (the peel strength after five rounds of dry cleaning) and the strength to resist a lateral pull described linear relations with the modulus of elasticity in bending of the reinforcing tape as shown in FIG. 3 and FIG. 4. It is noted from these diagrams that the resistance to dry cleaning and the strength to resist a lateral pull which amply exceed the respective standards, i.e. 1,000 g/cm and 12 kg, are manifested when the modulus of elasticity in bending is in the range of 3,000 to 5,000 kg/cm$^2$. If the modulus of elasticity in bending of the reinforcing tape is less than 3,000 kg/cm$^2$, the possibility arises that the reinforcing tape snaps along the boundary thereof with the pin-and-socket separator during the exertion of a lateral pull or it slips off the pin-and-socket separator.

Figure 6:
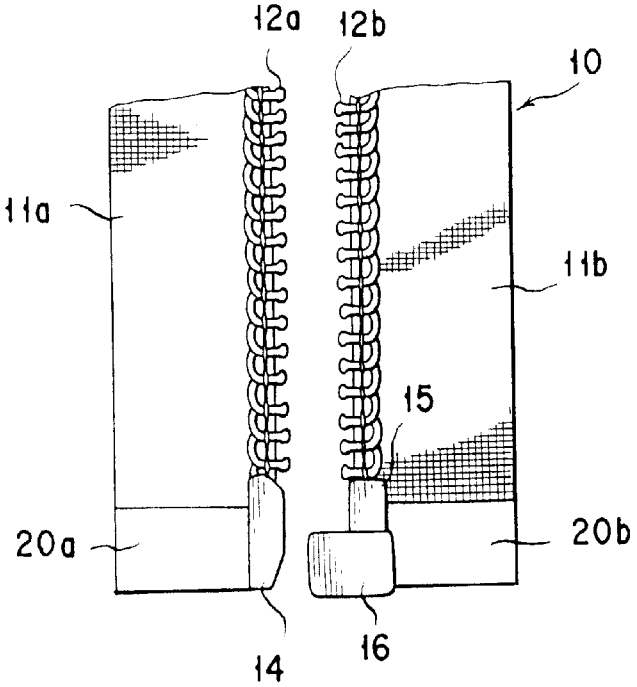
FIG. 6 is a fragmentary plan view showing the lower part of the slide fastener of FIG. 5 held in a separated state.

FIG. 5 and FIG. 6 each show the lower part of one example of a slide fastener 10 having the reinforcing tapes

20*a* and 20*b* of the present invention provided at the lower end portions of a pair of fastener tapes 11*a* and 11*b* to which members of a pin-and-socket separator are attached.

The slide fastener 10 shown in FIG. 5 includes a pair of fastener tapes 11*a* and 11*b*, a pair of reinforcing tapes 20*a* and 20*b* which are welded or bonded to the lower end portions of the respective fastener tapes 11*a* and 11*b*, rows of coupling elements 12*a* and 12*b*, such as spiral coil coupling elements, attached to the inner longitudinal edges of the respective fastener tapes 11*a* and 11*b*, a slider 13, and a pin-and-socket separator composed of an insertion member or butterfly bar 14, a box bar 15, and a box member 16, these members being secured to the inner edges of the reinforcing tapes 20*a* and 20*b* which are welded to the lower end portions of fastener tapes 11*a* and 11*b*. The slider 13 is slidably mounted on the rows of coupling elements 12*a* and 12*b* for engaging and disengaging the coupling elements 12*a* and 12*b*. FIG. 5 shows the slide fastener 10 in a closed state and FIG. 6 shows it in an opened state.

The fastener tapes 11*a* and 11*b* are manufactured by weaving or knitting a fibrous material formed of such synthetic fibers as polyester, nylon, etc. or such natural fibers as cotton. To the lower end portions of the pair of fastener tapes 11*a* and 11*b*, the reinforcing tapes 20*a* and 20*b* are respectively welded or bonded through the medium of an adhesive layer as explained hereinbefore. The butterfly bar 14 which is one of the fitting metal pieces for the pin-and-socket separator is secured to the inner edge of one, 20*a*, of the opposed reinforcing tapes and the box member 16 for admitting the butterfly bar 14 and the box bar 15 therefor are secured to the opposite inner edge of the other, 20*b*, of the reinforcing tapes. The butterfly bar 14 is releasably engageable in a slot in the box member 16. The box member 16 and the box bar 15 are integrally molded as one piece.

In the manner described above, the end portions of the fastener tapes 11*a* and 11*b* are reinforced by the application thereto with high adhesive strength of the reinforcing tapes 20*a* and 20*b* possessing such transparency or translucency as to allow the color of the fastener tapes to be seen therethrough and excelling in flexibility. Since the reinforcing tapes 20*a* and 20*b* are nearly transparent as a whole, they allow the color of the fastener tapes 11*a* and 11*b* to be directly seen therethrough. Since the reinforcing tapes appear in essentially the same color as the dyed fastener tapes, they will not impair the appearance of the fastener tapes. The reinforcing tape of one kind, therefore, can be applied to fastener tapes of varying colors. For the purpose of allaying the surface gloss of the reinforcing tape or augmenting the flexibility thereof, the reinforcing layer in the surface of the reinforcing tape may be knurled after or during the application of heat and pressure.

Since the reinforcing tape of the present invention uses for the reinforcing layer thereof a polyester elastomer film manifesting a modulus of elasticity in bending in the range of 3,000 to 5,000 kg/cm$^2$ as described above, it enjoys fully satisfactory suppleness and transparency and excels in resistance to dry cleaning and strength as well. By bonding a reinforcing tape of the construction described above to the end portion of a fastener tape through the medium of an adhesive layer, particularly a polyester hot-melt adhesive layer, the fastener tape is enabled to acquire a reinforced part having the reinforcing tape joined thereto with thorough adhesive strength. Further, since the reinforcing tape of the present invention excels in flexibility, it can be easily shaped in perfect conformity with the contour of the core portion of the fastener tape. When it is repeatedly folded, the folded portion is not whitened. When it is fixed to the fastener tape, it allows the color of the fastener tape to be directly seen therethrough and will not impair the appearance of the fastener tape. The reinforcing tape of one kind, therefore, can fit fastener tapes of varying colors. Thus, this reinforcing tape does not need to be prepared in various kinds elaborately adapted to fit such varying colors. It finds no use for any complicated management of storage.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. A reinforcing tape for a slide fastener, the tape comprising:

a polyester elastomer film having a modulus of elasticity in bending ranging from about 3,000 to about 5,000 kg/cm$^2$; and an adhesive layer.

2. The reinforcing tape according to claim 1, wherein said adhesive layer is a polyester-based hot-melt adhesive.

3. The reinforcing tape according to claim 1, wherein said adhesive layer is a hot-melt adhesive having a melting point ranging from about 110° to about 120° C. and a melt viscosity at 200° C. ranging from about 1,000 to about 2,000 poises.

4. The reinforcing tape according to claim 1, wherein said adhesive layer is a hot-melt adhesive comprising a resin of the same type as the material of a fastener tape of the slide fastener to which said adhesive layer is to be joined.

5. The reinforcing tape according to claim 1, wherein said polyester elastomer film has a thickness ranging from about 50 to about 200 $\mu$m and said adhesive layer has a thickness ranging from about 30 to about 120 $\mu$m.

6. The reinforcing tape according to claim 1, wherein the tape has a cloud point of not more than about 90%.

7. A reinforcing tape for a slide fastener, the tape comprising:

a polyester elastomer film having a modulus of elasticity in bending ranging from about 3,000 to about 5,000 kg/cm$^2$; and an adhesive layer comprising a hot-melt adhesive having a melting point ranging from about 110° to about 120° C. and a melt viscosity at 200° C. ranging from about 1,000 to about 2,000 poises.

8. A reinforcing tape for a slide fastener, the tape comprising:

a polyester elastomer film having a modulus of elasticity in bending ranging from about 3,000 to about 5,000 kg/cm$^2$; and an adhesive layer;

wherein the tape has a cloud point of not more than about 90%.

* * * * *